US012778191B2

(12) United States Patent
Chen et al.

(10) Patent No.: US 12,778,191 B2
(45) Date of Patent: Nov. 3, 2026

(54) ELECTRONIC VAPORIZATION DEVICE

(71) Applicant: SHENZHEN RELX TECHNOLOGY CO., LTD., Shenzhen City (CN)

(72) Inventors: Chen Chen, Shenzhen City (CN); Wenchen Gao, Shenzhen City (CN)

(73) Assignee: SHENZHEN RELX TECHNOLOGY CO., LTD., ShenZhen (CN)

( * ) Notice: Subject to any disclaimer, the term of this patent is extended or adjusted under 35 U.S.C. 154(b) by 736 days.

(21) Appl. No.: 18/254,326

(22) PCT Filed: Oct. 21, 2021

(86) PCT No.: PCT/CN2021/125256
§ 371 (c)(1),
(2) Date: Nov. 20, 2023

(87) PCT Pub. No.: WO2022/111153
PCT Pub. Date: Jun. 2, 2022

(65) Prior Publication Data

US 2024/0081394 A1 Mar. 14, 2024

(30) Foreign Application Priority Data

Nov. 24, 2020 (CN) ..... 202022755411.5

(51) Int. Cl.
*A24F 40/10* (2020.01)
*A24F 40/42* (2020.01)
*A24F 40/50* (2020.01)

(52) U.S. Cl.
CPC ..... *A24F 40/10* (2020.01); *A24F 40/42* (2020.01); *A24F 40/50* (2020.01)

(58) Field of Classification Search
CPC ..... A24F 40/10; A24F 40/42; A24F 40/50
See application file for complete search history.

(56) References Cited

U.S. PATENT DOCUMENTS

2014/0366894 A1* 12/2014 Liu ..... A24F 40/60 131/328
2016/0302483 A1* 10/2016 Liu ..... A24F 40/60
(Continued)

FOREIGN PATENT DOCUMENTS

CN 203536538 U 4/2014
CN 203662029 U 6/2014
(Continued)

OTHER PUBLICATIONS

Translation of CN 111887501A, European Patent office, [online], retrieved from the Internet, [retrieved Mar. 2, 2026], URL:https://worldwide.espacenet.com/patent/search/family/073191841/publication/CN111887501A?q=CN111887501 (Year: 2026).*
(Continued)

*Primary Examiner* — Dennis R Cordray
(74) *Attorney, Agent, or Firm* — ScienBiziP, P.C.

(57) ABSTRACT

An electronic vaporization device includes a vaporizable material storage device and an electronic vaporization device body. The electronic vaporization device body includes a first light source, and a second light source. In response to a control signal indicating that a user is starting to use, the electronic vaporization device enters a start stage, and performs the following operations in the start stage: controlling the first light source to increase the brightness from first preset brightness at a first rate at a first time point, and the second light source to increase the brightness from the first preset brightness at a second rate at a second time point, where the first time point is earlier than the second time point, and the first rate is less than the second rate.

10 Claims, 11 Drawing Sheets

(56) References Cited

U.S. PATENT DOCUMENTS

| | | | | |
|---|---|---|---|---|
| 2016/0374397 | A1* | 12/2016 | Jordan | A24F 40/53 131/329 |
| 2017/0079110 | A1 | 3/2017 | Plattner | |
| 2018/0020725 | A1* | 1/2018 | Alarcon | A61M 15/06 |

FOREIGN PATENT DOCUMENTS

| | | | |
|---|---|---|---|
| CN | 204796732 | U | 11/2015 |
| CN | 210809317 | U | 6/2020 |
| CN | 111743209 | A | 10/2020 |
| CN | 111887501 | A | 11/2020 |
| CN | 214710372 | U | 11/2021 |
| EP | 3011849 | A1 | 4/2016 |

OTHER PUBLICATIONS

PCT International Search Report mailed Jan. 24, 2022 in counterpart PCT application PCT/CN2021/125256, 3 pages in English.

* cited by examiner

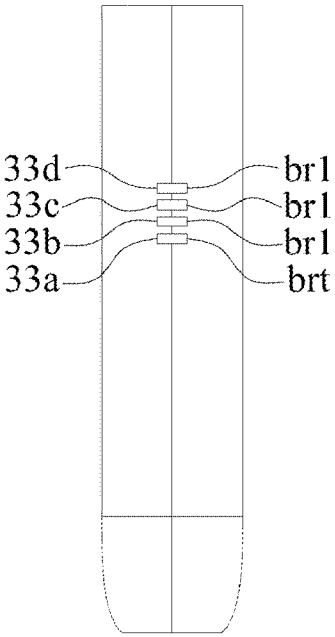
FIG. 9A
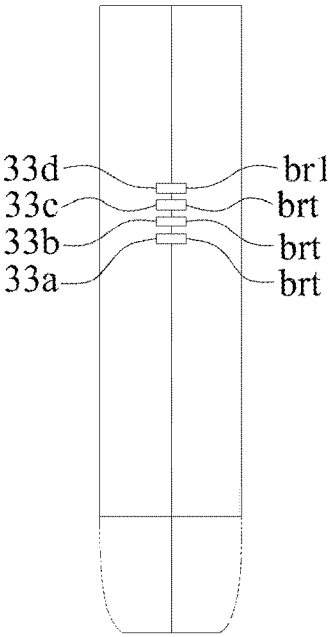
FIG. 9B
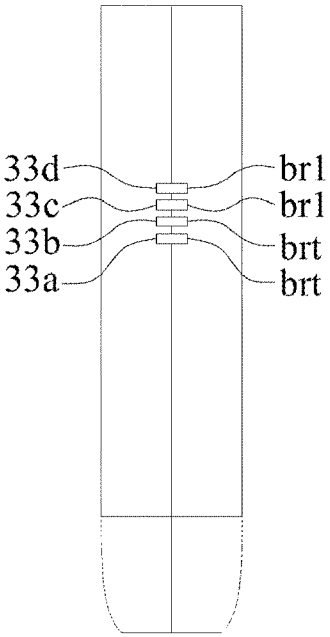
FIG. 9C
FIG. 9D

ELECTRONIC VAPORIZATION DEVICE

CROSS-REFERENCE TO RELATED APPLICATION

This application is a national stage application filed under 35 U.S.C 371 of International Application No. PCT/CN2021/125256 filed Oct. 21, 2021, which claims priority to China Patent Application 202022755411.5 filed Nov. 24, 2020. The entire disclosures of the above applications are incorporated herein by reference in their entirety.

BACKGROUND OF THE INVENTION

In recent years, major manufacturers have begun to produce a variety of electronic vaporization device products, including smoke liquid type electronic vaporization device products that heat and vaporize a volatile solution and produce vapor for users to smoke. Smoke liquid generally includes flavoring agents with different flavors, and can be vaporized to produce different fragrances.

FIELD OF THE INVENTION

This application relates to an electronic device, and in particular to an electronic vaporization device.

SUMMARY

This application provides an electronic vaporization device, which provides different light effects in a manner different from the prior art, to provide users with different use experiences.

This application provides an electronic vaporization device. The electronic vaporization device includes an vaporizable material storage device and an electronic vaporization device body. The vaporizable material storage device is configured to store an vaporizable material. The electronic vaporization device body is detachably connected to the vaporizable material storage device. The electronic vaporization device body includes a processing circuit, a sensing device, a first light source, and a second light source. The sensing device is connected to the processing circuit, and is configured to sense changes in air flow and transmit a control signal to the processing circuit. The first light source and the second light source are separately electrically connected to the processing circuit. In response to the control signal indicating that a user starts to use, the processing circuit controls the electronic vaporization device to enter a start stage, and performs the following operations in the start stage: controlling the first light source to increase the brightness from first preset brightness at a first rate at a first time point; and controlling the second light source to increase the brightness from the first preset brightness at a second rate at a second time point, where the first time point is earlier than the second time point, and the first rate is less than the second rate.

As an implementation, the processing circuit further performs the following operations in the start stage: controlling the first light source and the second light source to increase the brightness to target brightness at a third time point, where the second time point is earlier than the third time point.

As an implementation, in response to the control signal indicating that the user continues to use and that the first light source and the second light source reach the target brightness, the processing circuit controls the electronic vaporization device to enter a cycle stage, and performs the following operations in the cycle stage: controlling the first light source to decrease the brightness from the target brightness at a third rate at a fourth time point; and controlling the second light source to decrease the brightness from the target brightness at a fourth rate at a fifth time point; where the fourth time point is earlier than the fifth time point; and the third rate is less than the fourth rate.

As an implementation, the processing circuit further performs the following operations in the cycle stage: controlling the first light source and the second light source to decrease the brightness to second preset brightness at a sixth time point; where the fifth time point is earlier than the sixth time point; and the second preset brightness is greater than the first preset brightness.

As an implementation, the processing circuit further performs the following operations in the cycle stage: controlling the first light source to increase the brightness from the second preset brightness at a fifth rate at a seventh time point; and controlling the second light source to increase the brightness from the second preset brightness at a sixth rate at an eighth time point, where the seventh time point is earlier than the eighth time point; and the fifth rate is less than the sixth rate.

As an implementation, the processing circuit further performs the following operations in the cycle stage: controlling the first light source and the second light source to increase the brightness from the second preset brightness to the target brightness at a ninth time point, where the eighth time point is earlier than the ninth time point.

As an implementation, an interval between the fourth time point and the fifth time point is the same as an interval between the seventh time point and the eighth time point.

As an implementation, in response to the control signal indicating that the user stops to use, the processing circuit controls the electronic vaporization device to enter a termination stage, and performs the following operations in the termination stage: controlling the first light source and the second light source to decrease the brightness separately at the third rate and the fourth rate at the third time point, and to decrease the brightness to the first preset brightness separately at the fourth time point and the fifth time point, where the third rate is less than the fourth rate.

As an implementation, an interval between the first time point and the second time point is the same as an interval between the fourth time point and the fifth time point.

As an implementation, the electronic vaporization device further includes a power supply. The power supply is configured to store and supply electric energy, where the processing circuit is further configured to control the brightness of the first light source and the brightness of the second light source according to the electric energy stored in the power supply.

BRIEF DESCRIPTION OF THE DRAWINGS

The accompanying drawings are intended to provide a further understanding of this application and constitute a part of this description. The accompanying drawings and specific implementations below are used together for explaining this application rather than constituting a limitation on this application. In the drawings:

FIG. 9A to FIG. 9D are respectively schematic diagrams showing brightness changes of a light emitting assembly of the electronic vaporization device according to an embodiment of this application at different residual powers of a power supply.

DETAILED DESCRIPTION

Figure 1:
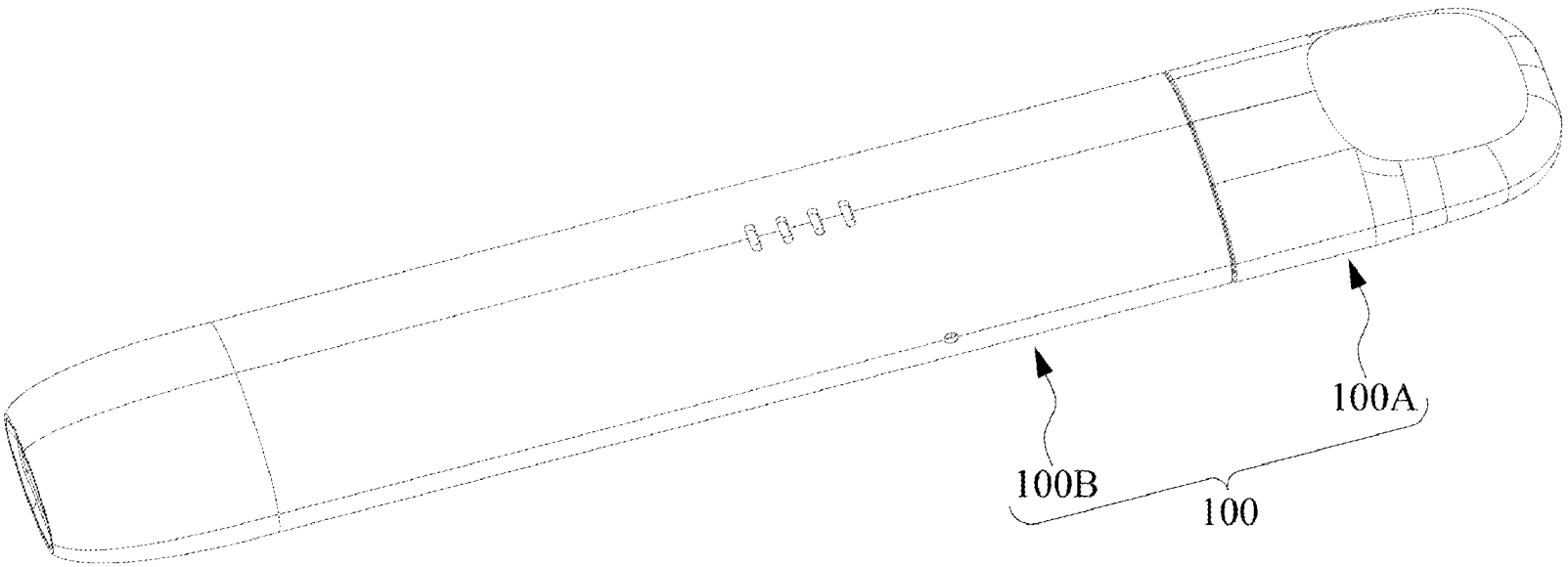
FIG. 1 is a schematic diagram of a front view of an electronic vaporization device according to some embodiments of this application.

The following disclosure provides many different embodiments or examples for implementing different features of the provided subject matter. Specific examples of components and arrangements are described below. Of course, these are only examples and are not intended to be restrictive. In this application, the reference to formation of a first feature being above or on a second feature in the following description may include an embodiment formed by direct contact between the first feature and the second feature, and may also include an embodiment in which an additional feature may be formed between the first feature and the second feature, so that the first feature and the second feature may not be in direct contact. In addition, in this application, reference numerals and/or reference letters may be repeated in various examples. The repetition is for the purposes of simplification and clearness, and is not intended to indicate relationships between the various embodiments and/or configurations discussed herein.

The following details the embodiments of this application. However, it should be understood that this application provides many applicable concepts that can be implemented in a variety of specific scenarios. The specific embodiments discussed are only illustrative and do not limit the scope of this application.

FIG. 1 is a schematic diagram of a front view of an electronic vaporization device 100 according to some embodiments of this application.

The electronic vaporization device 100 may include an vaporizable material storage device 100A and a body 100B. In some embodiments, the vaporizable material storage device 100A and the body 100B may be designed as a whole. In some embodiments, the vaporizable material storage device 100A and the body 100B may be designed as two separate components. In some embodiments, the vaporizable material storage device 100A may be designed to be detachably combined with the body 100B. In some embodiments, when the vaporizable material storage device 100A is combined with the body 100B, a portion of the vaporizable material storage device 100A is stored in the body 100B. In some embodiments, the vaporizable material storage device 100A may be referred to as a cartridge or an oil storage assembly. In some embodiments, the body 100B may be referred to as main body.

The body 100B may provide electrical power for the vaporizable material storage device 100A. The electrical power provided by the body 100B to the vaporizable material storage device 100A may heat an vaporizable material stored in the vaporizable material storage device 100A. The vaporizable material may be a liquid. The vaporizable material may be a solution. The vaporizable material may also be referred to as smoke liquid. Smoke liquid is edible.

Figure 2:
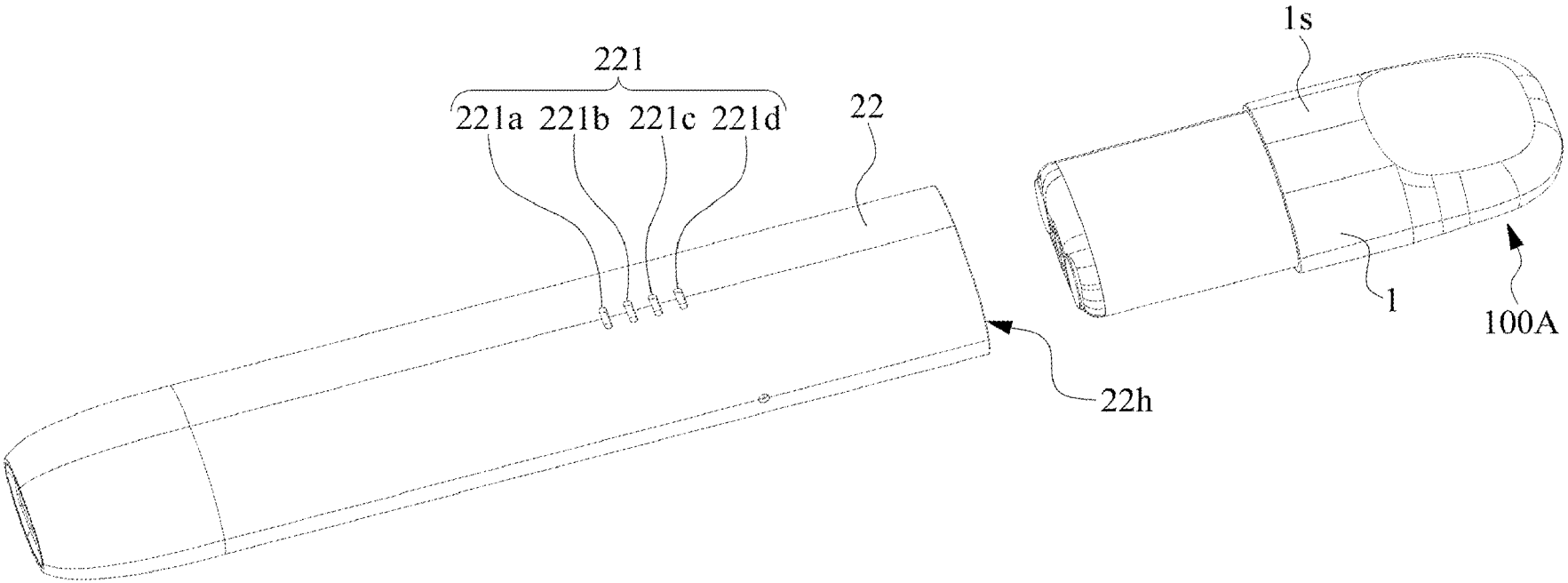
FIG. 2 is an exemplary schematic combination diagram of an electronic vaporization device according to some embodiments of this application.

FIG. 2 is an exemplary schematic combination diagram of an electronic vaporization device 100 according to some embodiments of this application.

The body 100B has a body housing 22. The body housing 22 has an opening 22*h*. The opening 22*h* may store a portion of the vaporizable material storage device 100A. In some embodiments, a surface (for example, a front surface shown in FIG. 2) of the body 100B is provided with a light transmitting assembly 221. The light transmitting assembly 221 may be encircled to form a specific shape or pattern, for example, a straight line or circular shape. In subsequent embodiments, the light transmitting assembly 221 is arranged in a straight line shape as an example for illustration. The light transmitting assembly 221 may be a through hole. The shape of the through hole may be, for example, a long oval shape. In some embodiments, the light transmitting assembly 221 includes light transmitting components 221*a*, 221*b*, 221*c*, and 221*d*. However, a quantity of the light transmitting components included in the light transmitting assembly 221 is only an example and is not a limitation on this application.

In some embodiments, the vaporizable material storage device 100A may not have directionality. In some embodiments, the vaporizable material storage device 100A may be detachably combined with the body 100B in two different directions (namely, when a surface is facing up or down).

Figure 3:
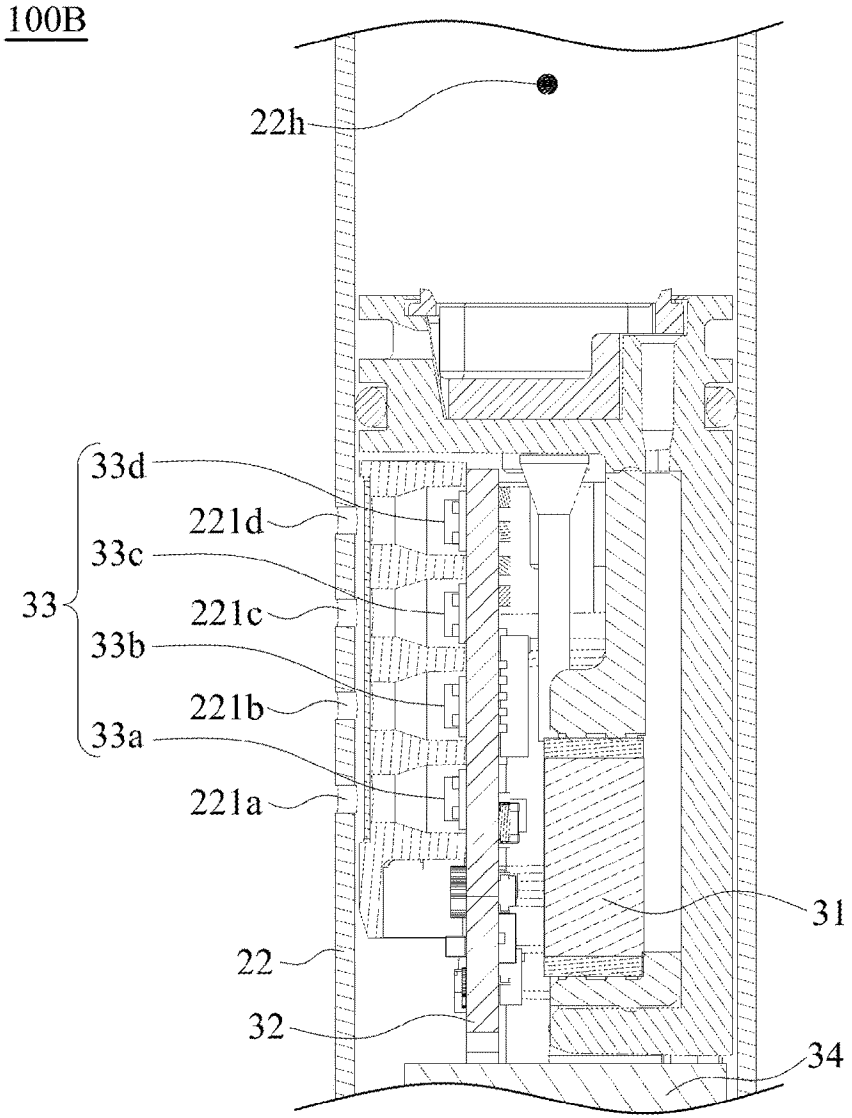
FIG. 3 is a cross-sectional view of an electronic vaporization device body according to some embodiments of this application.

FIG. 3 is a cross-sectional view of an electronic vaporization device body 100B according to some embodiments of this application. The housing 22 of the electronic vaporization device body 100B includes a sensing device 31, a processing circuit 32, and a light emitting assembly 33. The processing circuit 32 is electrically connected to the sensing device 31 and the light emitting assembly 33. In some embodiments, the sensing device 31 is configured to sense changes in air flow of the electronic vaporization device 100 and transmit a control signal CS to the processing circuit 32. In some embodiments, when the sensing device 31 senses a change in the air flow of the electronic vaporization device 100, it means that a user is using the electronic vaporization device 100 and causes a change in the air flow of the electronic vaporization device 100.

In some embodiments, light emitted by the light emitting assembly 33 is visible through the light transmitting assembly 221. In some embodiments, the light emitting assembly 33 includes a first light source 33*a*, a second light source 33*b*, a third light source 33*c*, and a fourth light source 33*d*. Arrangement positions of the first light source 33*a*, the second light source 33*b*, the third light source 33*c*, and the fourth light source 33*d* correspond to the light transmitting components 221*a*, 221*b*, 221*c*, and 221*d*, respectively. It should be noted that a quantity of the light sources included in the light emitting assembly 33 is only an example and is not a limitation on this application.

In some embodiments, the processing circuit 32 controls the brightness of the light sources of the light emitting assembly 33 in response to the control signal CS to present different light effects and provide the user with different user experiences. In some embodiments, the processing circuit 32 may be a microprocessor. The processing circuit 32 may be a programmable integrated circuit. The processing circuit 32 may be a programmable logic circuit. In some embodiments, an operational logic in the processing circuit 32 cannot be modified after manufacturing. In some embodiments, an operational logic in the processing circuit 32 can be programmably modified after manufacturing.

Figure 4:
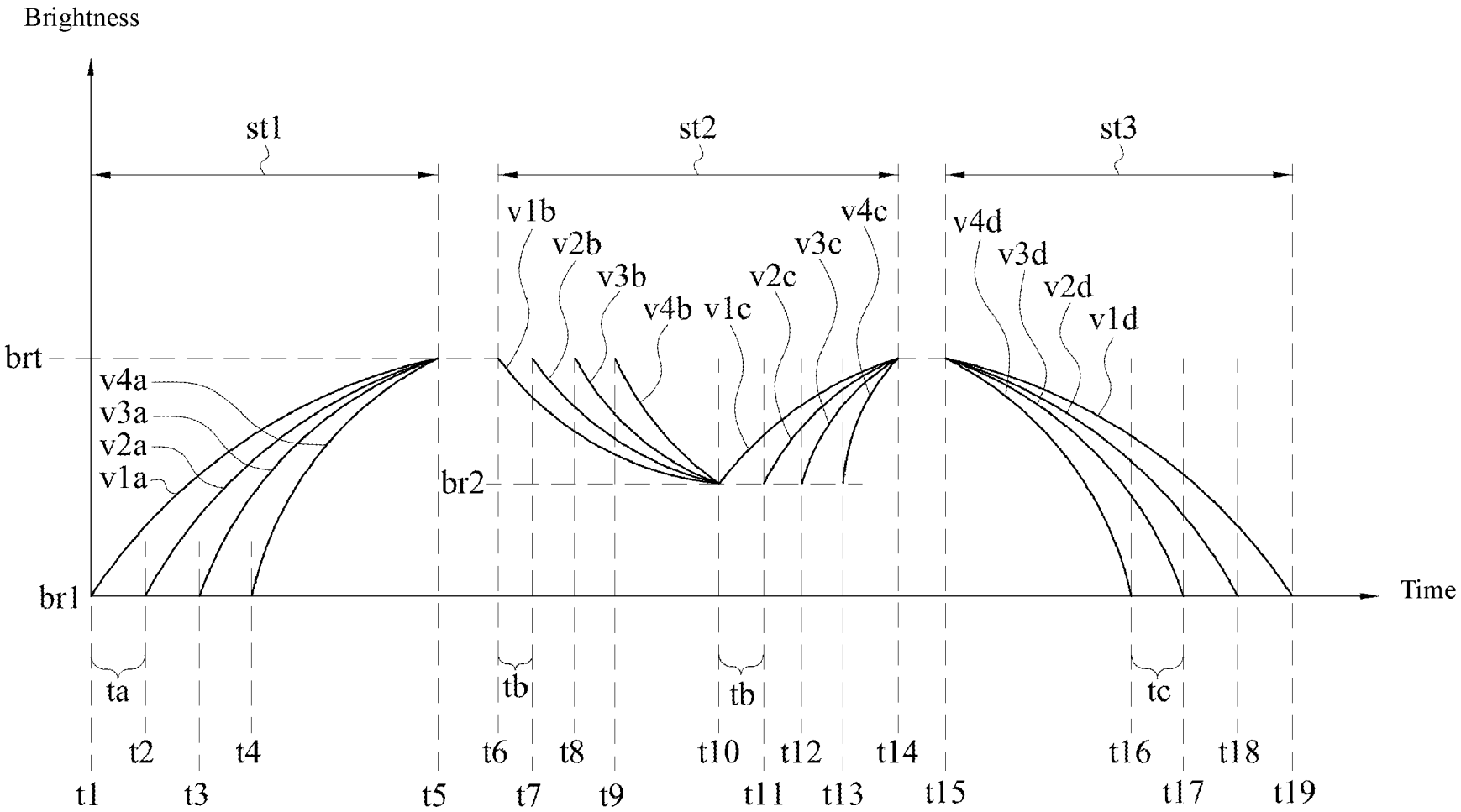
FIG. 4 is a schematic diagram showing brightness changes of a light emitting assembly when an electronic vaporization device according to an embodiment of this application is in different stages.

FIG. 4 is a schematic diagram showing brightness changes of a light emitting assembly 33 when an electronic vaporization device 100 according to an embodiment of this application is in different stages.

In some embodiments, when the sensing device 31 senses that the user starts to use the electronic vaporization device 100, the control signal CS instructs the electronic vaporization device 100 to enter a start stage st1. In response to the control signal CS, the processing circuit 32 controls the first light source 33*a*, the second light source 33*b*, the third light source 33*c*, and the fourth light source 33*d*, so that the first light source 33*a* is configured to increase the brightness from first preset brightness br1 at a first rate vla at a first time point t1, the second light source 33*b* is configured to increase the brightness from the first preset brightness br1 at a second rate v2*a* at a second time point t2, the third light source 33*c* is configured to increase the brightness from the first preset brightness br1 at a third rate v3*a* at a third time point t3, and the fourth light source 33*d* is configured to increase the brightness from the first preset brightness br1 at a fourth rate v4*a* at a fourth time point t4. In response to the control signal CS, the processing circuit 32 also controls the first light source 33*a*, the second light source 33*b*, the third light source 33*c*, and the fourth light source 33*d*, so that the brightness of the first light source 33*a*, the brightness of the second light source 33*b*, the brightness of the third light source 33*c*, and the brightness of the fourth light source 33*d* are configured to be increased to target brightness brt at a fifth time point t5.

In some embodiments, the first preset brightness br1 may be zero. In some embodiments, the first time point t1 is earlier than the second time point t2. The second time point t2 is earlier than the third time point t3. The third time point t3 is earlier than the fourth time point t4. In some embodiments, an interval between the first time point t1 and the second time point t2, an interval between the second time point t2 and the third time point t3, and an interval between the third time point t3 and the fourth time point t4 are ta. In some embodiments, the first rate vla is less than the second rate v2*a*, the second rate v2*a* is less than the third rate v3*a*, and the third rate v3*a* is less than the fourth rate v4*a*.

FIG. 5A to FIG. 5E are respectively schematic diagrams showing brightness changes of a light emitting assembly 33 in a start stage st1 according to an embodiment of this application.

Figures 5A, 5B, 5C, 5D, 5E:
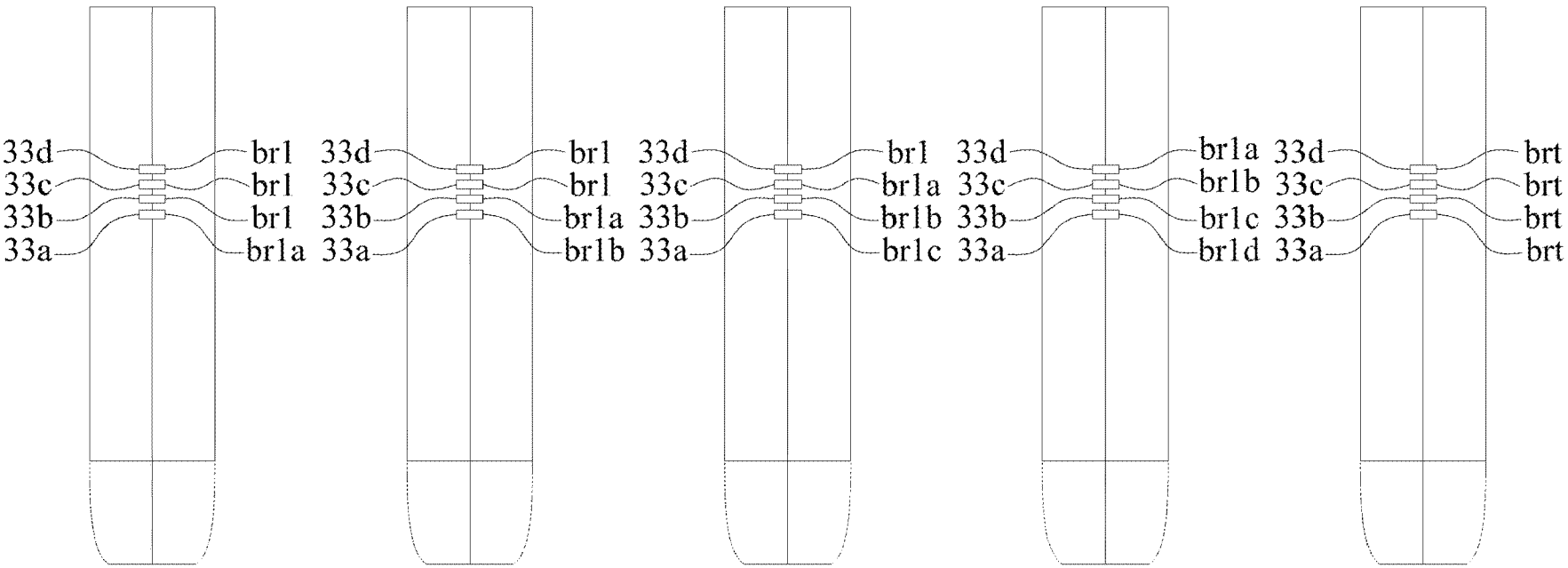
FIG. 5A to FIG. 5E are respectively schematic diagrams showing brightness changes of a light emitting assembly in a start stage according to an embodiment of this application.

FIG. 5A shows the brightness of the light emitting assembly 33 after the first time point t1 and before the second time point t2. In response to the control signal CS, the processing circuit 32 controls the first light source 33*a*, the second light source 33*b*, the third light source 33*c*, and the fourth light source 33*d*, so that the first light source 33*a* is configured with brightness br1*a*, and the second light source 33*b*, the third light source 33*c*, and the fourth light source 33*d* are configured with the first preset brightness br1, wherein the brightness br1*a* is greater than the first preset brightness br1.

FIG. 5B shows the brightness of the light emitting assembly 33 after the second time point t2 and before the third time point t3. In response to the control signal CS, the processing circuit 32 controls the first light source 33*a*, the second light source 33*b*, the third light source 33*c*, and the fourth light source 33*d*, so that the first light source 33*a* is configured with brightness brlb, the second light source 33*b* is configured with brightness br1*a*, and the third light source 33*c* and the fourth light source 33*d* are configured with the first preset brightness br1, wherein the brightness brlb is greater than the brightness br1*a*.

FIG. 5C shows the brightness of the light emitting assembly 33 after the third time point t3 and before the fourth time point t4. In response to the control signal CS, the processing circuit 32 controls the first light source 33*a*, the second light source 33*b*, the third light source 33*c*, and the fourth light source 33*d*, so that the first light source 33*a* is configured with brightness br1*c*, the second light source 33*b* is configured with brightness br1*b*, the third light source 33*c* is configured with brightness br1*a*, and the fourth light source 33*d* is configured with the first preset brightness br1, wherein the brightness br1*c* is greater than the brightness br1*b*.

FIG. 5D shows the brightness of the light emitting assembly 33 after the fourth time point t4 and before the fifth time point t5. In response to the control signal CS, the processing circuit 32 controls the first light source 33*a*, the second light source 33*b*, the third light source 33*c*, and the fourth light source 33*d*, so that the first light source 33*a* is configured with brightness br1*d*, the second light source 33*b* is configured with brightness br1*c*, the third light source 33*c* is configured with brightness br1*b*, and the fourth light source 33*d* is configured with brightness br1*a*, wherein the brightness br1*d* is greater than the brightness br1*c*.

FIG. 5E shows the brightness of the light emitting assembly 33 at the fifth time point t5. In response to the control signal CS, the processing circuit 32 controls the first light source 33*a*, the second light source 33*b*, the third light source 33*c*, and the fourth light source 33*d*, so that the first light source 33*a*, the second light source 33*b*, the third light source 33*c*, and the fourth light source 33*d* are configured with the target brightness brt.

According to the embodiments of FIG. 5A to FIG. 5E, in response to the control signal CS, the processing circuit 32 controls the light sources of the light emitting assembly 33 to be turned on in sequence from the first light source 33*a* at the bottommost in the start stage st1, and controls the light sources of the light emitting assembly 33 to reach the target brightness at the same time point. In this way, the light emitting assembly 33 will present an effect similar to smoke flowing upwards during use by the user.

Referring to FIG. 4 again, in some embodiments, when the sensing device 31 senses that the user still uses after the fifth time point t5, the control signal CS instructs the electronic vaporization device 100 to enter a cycle stage st2. In response to the control signal CS, the processing circuit 32 controls the first light source 33*a*, the second light source 33*b*, the third light source 33*c*, and the fourth light source 33*d*, so that the first light source 33*a* is configured to decrease the brightness from the target brightness brt at a fifth rate vlb at a sixth time point t6, the second light source 33*b* is configured to decrease the brightness from the target brightness brt at a sixth rate v2*b* at a seventh time point t7, the third light source 33*c* is configured to decrease the brightness from the target brightness brt at a seventh rate v3*b* at an eighth time point t8, and the fourth light source 33*d* is configured to decrease the brightness from the target brightness brt at an eighth rate v4*b* at a ninth time point t9. In response to the control signal CS, the processing circuit 32 also controls the first light source 33*a*, the second light source 33*b*, the third light source 33*c*, and the fourth light source 33*d*, so that the brightness of the first light source 33*a*, the brightness of the second light source 33*b*, the brightness of the third light source 33*c*, and the brightness of the fourth light source 33*d* are decreased to second preset brightness br2 at a tenth time point t10.

In some embodiments, the second preset brightness br2 is greater than the first preset brightness br1. In some embodiments, the second preset brightness br2 may be equal to the first preset brightness br1. In some embodiments, the sixth time point t6 is earlier than the seventh time point t7, the seventh time point t7 is earlier than the eighth time point t8, the eighth time point t8 is earlier than the ninth time point t9, and the ninth time point t9 is earlier than the tenth time point t10. In some embodiments, an interval between the sixth time point t6 and the seventh time point t7, an interval between the seventh time point t7 and the eighth time point t8, and an interval between the eighth time point t8 and the ninth time point t9 are tb. In some embodiments, the interval ta is the same as the interval tb. In some embodiments, the interval ta is different from the interval tb. In some embodiments, the fifth rate vlb is less than the sixth rate v2*b*, the sixth rate v2*b* is less than the seventh rate v3*b*, and the seventh rate v3*b* is less than the eighth rate v4*b*.

After the tenth time point t10, in response to the control signal CS, the processing circuit 32 controls the first light source 33*a*, the second light source 33*b*, the third light source 33*c*, and the fourth light source 33*d*, so that the first light source 33*a* is configured to increase the brightness from the second preset brightness br2 at a ninth rate v1*c* at the tenth time point t10, the second light source 33*b* is configured to increase the brightness from the second preset brightness br2 at a tenth rate v2*c* at an eleventh time point t11, the third light source 33*c* is configured to increase the brightness from the second preset brightness br2 at an eleventh rate v3*c* at a twelfth time point t12, and the fourth light source 33*d* is configured to increase the brightness from the second preset brightness br2 at a twelfth rate v4*c* at a thirteenth time point t13. In response to the control signal CS, the processing circuit 32 also controls the first light source 33*a*, the second light source 33*b*, the third light source 33*c*, and the fourth light source 33*d*, so that the brightness of the first light source 33*a*, the brightness of the second light source 33*b*, the brightness of the third light source 33*c*, and the brightness of the fourth light source 33*d* are configured to be increased to the target brightness brt at a fourteenth time point t14.

In some embodiments, the tenth time point t10 is earlier than the eleventh time point t11, the eleventh time point t11 is earlier than the twelfth time point t12, the twelfth time point t12 is earlier than the thirteenth: time point t13, the thirteenth time point t13 is earlier than the fourteenth time point t14. In some embodiments, an interval between the tenth time point t10 and the eleventh time point t11, an interval between the eleventh time point t11 and the twelfth time point t12, and an interval between the twelfth time point t12 and the thirteenth time point t13 are tb. In some embodiments, the ninth rate v1*c* is less than the tenth rate v2*c*, the tenth rate v2*c* is less than the eleventh rate v3*c*, and the eleventh rate v3*c* is less than the twelfth rate v4*c*.

It should be noted that in some embodiments, when the first light source 33*a*, the second light source 33*b*, the third light source 33*c*, and the fourth light source 33*d* reach the second preset brightness br2 at the tenth time point t10, it is not limited to immediately increase the brightness of the first light source 33*a* at the tenth time point t10. The brightness of the first light source 33*a* can be increased after a certain time interval.

A cycle of the cycle stage st2 is from the sixth time point t6 to the fourteenth time point t14. If the sensing device 31 senses that the user still uses after the fourteenth time point t14, the control signal CS instructs the electronic vaporization device 100 to repeatedly enter the cycle stage st2.

FIG. 6A to FIG. 6J are respectively schematic diagrams showing brightness changes of a light emitting assembly 33 in a cycle stage st2 according to an embodiment of this application.

Figures 6A, 6B, 6C, 6D, 6E:
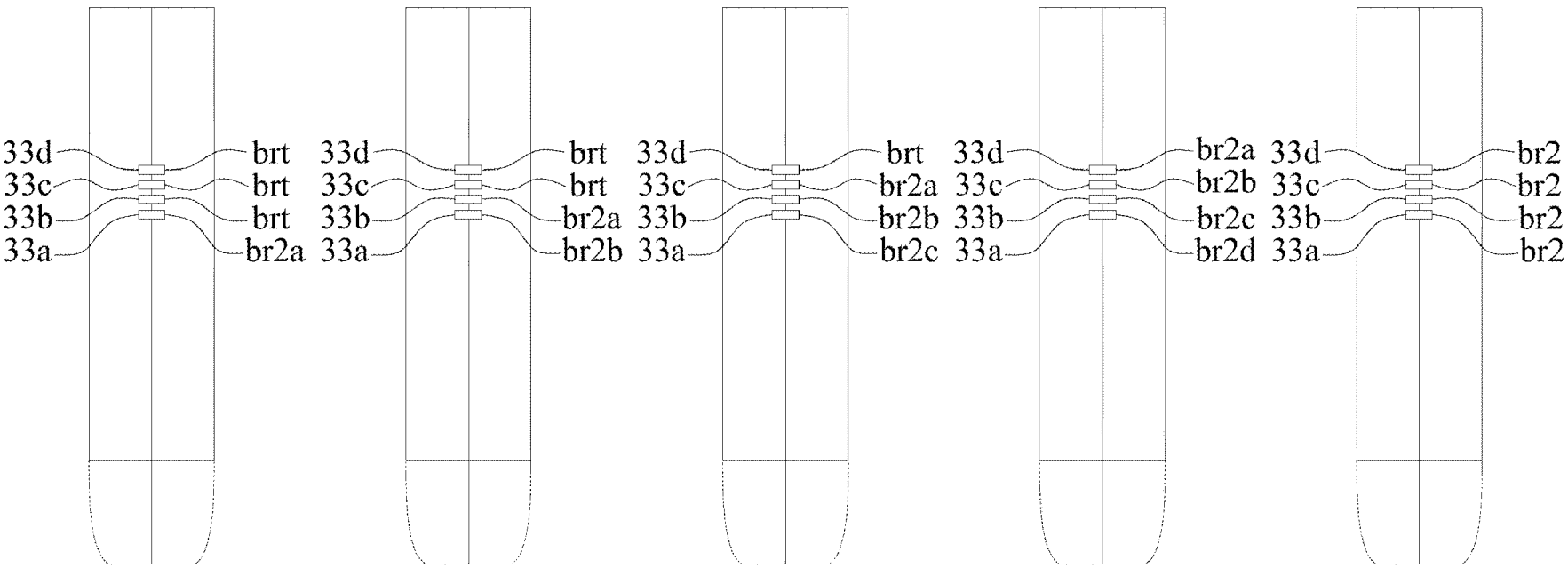
FIG. 6A to FIG. 6J are respectively schematic diagrams showing brightness changes of a light emitting assembly in a cycle stage according to an embodiment of this application.

FIG. 6A shows the brightness of the light emitting assembly 33 after the sixth time point t6 and before the seventh time point t7. In response to the control signal CS, the processing circuit 32 controls the first light source 33*a*, the second light source 33*b*, the third light source 33*c*, and the fourth light source 33*d*, so that the first light source 33*a* is configured with brightness br2*a*, and the second light source 33*b*, the third light source 33*c*, and the fourth light source 33*d* are configured with the target brightness brt, wherein the brightness br2*a* is less than the target brightness brt.

FIG. 6B shows the brightness of the light emitting assembly 33 after the seventh time point t7 and before the eighth time point t8. In response to the control signal CS, the processing circuit 32 controls the first light source 33*a*, the second light source 33*b*, the third light source 33*c*, and the fourth light source 33*d*, so that the first light source 33*a* is configured with brightness br2*b*, the second light source 33*b* is configured with brightness br2*a*, and the third light source 33*c* and the fourth light source 33*d* are configured with the target brightness brt, wherein the brightness br2*b* is less than the brightness br2*a*.

FIG. 6C shows the brightness of the light emitting assembly 33 after the eighth time point t8 and before the ninth time point t9. In response to the control signal CS, the processing circuit 32 controls the first light source 33*a*, the second light source 33*b*, the third light source 33*c*, and the fourth light source 33*d*, so that the first light source 33*a* is configured with brightness br2*c*, the second light source 33*b* is configured with brightness br2*b*, the third light source 33*c* is configured with brightness br2*a*, and the fourth light source 33*d* is configured with the target brightness brt, wherein the brightness br2*c* is less than the brightness br2*b*.

FIG. 6D shows the brightness of the light emitting assembly 33 after the ninth time point t9 and before the tenth time point t10. In response to the control signal CS, the processing circuit 32 controls the first light source 33*a*, the second light source 33*b*, the third light source 33*c*, and the fourth light source 33*d*, so that the first light source 33*a* is configured with brightness br2*d*, the second light source 33*b* is configured with brightness br2*c*, the third light source 33*c* is configured with brightness br2*b*, and the fourth light source 33*d* is configured with brightness br2*a*, wherein the brightness br2*d* is less than the brightness br2*c*.

FIG. 6E shows the brightness of the light emitting assembly 33 at the tenth time point t10. In response to the control signal CS, the processing circuit 32 controls the first light source 33*a*, the second light source 33*b*, the third light source 33*c*, and the fourth light source 33*d*, so that the first light source 33*a*, the second light source 33*b*, the third light source 33*c*, and the fourth light source 33*d* are configured with the second preset brightness br2.

Figures 6F, 6G, 6H, 6I, 6J:
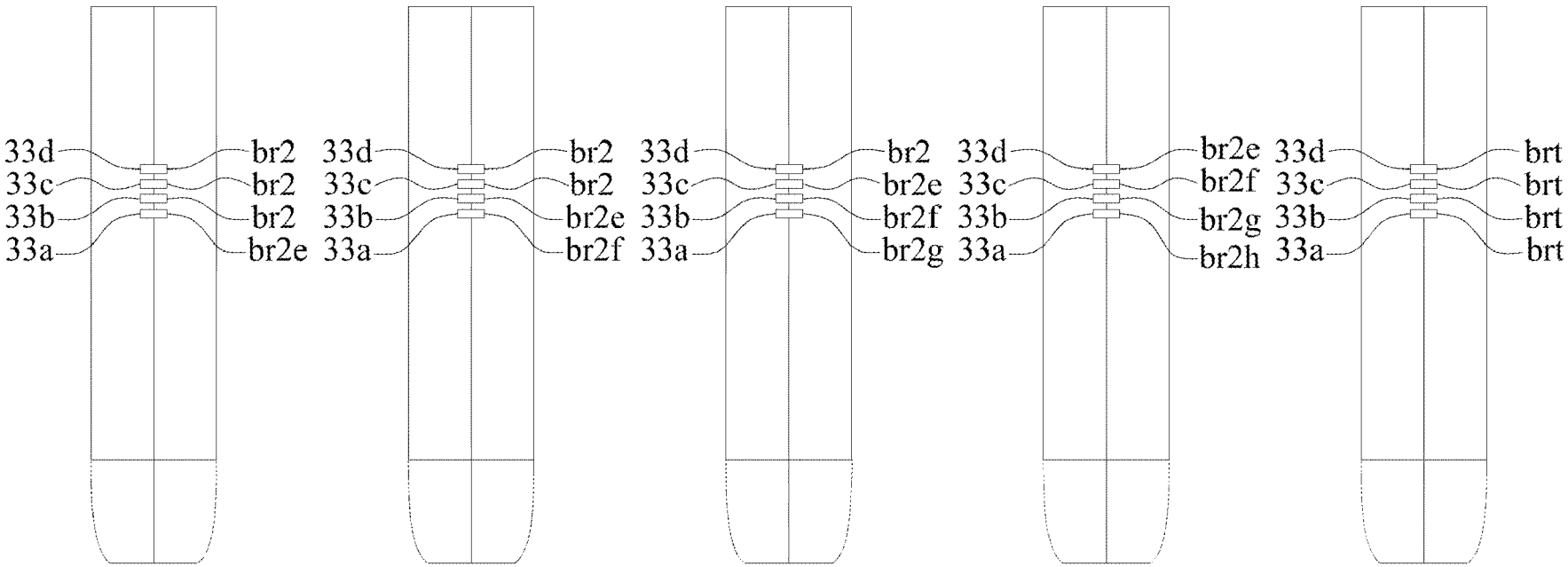

FIG. 6F shows the brightness of the light emitting assembly 33 after the tenth time point t10 and before the eleventh time point tl1. In response to the control signal CS, the processing circuit 32 controls the first light source 33*a*, the second light source 33*b*, the third light source 33*c*, and the fourth light source 33*d*, so that the first light source 33*a* is configured with brightness br2*e*, and the second light source 33*b*, the third light source 33*c*, and the fourth light source 33*d* are configured with the second preset brightness br2, wherein the brightness br2*e* is greater than the second preset brightness br2.

FIG. 6G shows the brightness of the light emitting assembly 33 after the eleventh time point t11 and before the twelfth time point t12. In response to the control signal CS, the processing circuit 32 controls the first light source 33*a*, the second light source 33*b*, the third light source 33*c*, and the fourth light source 33*d*, so that the first light source 33*a* is configured with brightness br2*f*, the second light source 33*b* is configured with brightness br2*e*, and the third light source 33*c* and the fourth light source 33*d* are configured with the second preset brightness br2, wherein the brightness br2*f* is greater than the brightness br2*e*.

FIG. 6H shows the brightness of the light emitting assembly 33 after the twelfth time point t12 and before the thirteenth time point t13. In response to the control signal CS, the processing circuit 32 controls the first light source 33*a*, the second light source 33*b*, the third light source 33*c*, and the fourth light source 33*d*, so that the first light source 33*a* is configured with brightness br2*g*, the second light source 33*b* is configured with brightness br2*f*, the third light source 33*c* is configured with brightness br2*e*, and the fourth light source 33*d* is configured with the second preset brightness br2, wherein the brightness br2*g* is greater than the brightness br2*f*.

FIG. 6I shows the brightness of the light emitting assembly 33 after the thirteenth time point t13 and before the fourteenth time point t14. In response to the control signal CS, the processing circuit 32 controls the first light source 33*a*, the second light source 33*b*, the third light source 33*c*, and the fourth light source 33*d*, so that the first light source 33*a* is configured with brightness br2*h*, the second light source 33*b* is configured with brightness br2*g*, the third light source 33*c* is configured with brightness br2*f*, and the fourth light source 33*d* is configured with brightness br2*e*, wherein the brightness br2*h* is greater than the brightness br2*g*.

FIG. 6J shows the brightness of the light emitting assembly 33 at the fourteenth time point t14. In response to the control signal CS, the processing circuit 32 controls the first light source 33*a*, the second light source 33*b*, the third light source 33*c*, and the fourth light source 33*d*, so that the first light source 33*a*, the second light source 33*b*, the third light source 33*c*, and the fourth light source 33*d* are configured with the target brightness brt.

According to the embodiments of FIG. 6A to FIG. 6J, in response to the control signal CS, the processing circuit 32 controls the light sources of the light emitting assembly 33 to start to be dimmed out in sequence from the first light source 33*a* at the bottommost in the cycle stage st2. When the brightness of all the light sources is decreased to the second preset brightness br2, the light sources start to be dimmed up in sequence from the first light source 33*a* at the bottommost. Furthermore, the light sources of the light emitting assembly 33 are controlled to reach the target brightness at the same time point.

Referring to FIG. 4 again, in some embodiments, when the sensing device 31 senses that the user stops using the electronic vaporization device after the fourteenth time point t14, the control signal CS instructs the electronic vaporization device 100 to enter a termination stage st3. In response to the control signal CS, the processing circuit 32 controls the first light source 33*a*, the second light source 33*b*, the third light source 33*c*, and the fourth light source 33*d*, so that the first light source 33*a* is configured to decrease the brightness from the target brightness brt at a thirteenth rate v1*d* at a fifteenth time point t15, the second light source 33*b* is configured to decrease the brightness from the target brightness brt at a fourteenth rate v2*d* at the fifteenth time point t15, the third light source 33*c* is configured to decrease the brightness from the target brightness brt at a fifteenth rate v3*d* at the fifteenth time point t15, and the fourth light source 33*d* is configured to decrease the brightness from the target brightness brt at a sixteenth rate v4*d* at the fifteenth time point t15. In response to the control signal CS, the processing circuit 32 also controls the first light source 33*a*, the second light source 33*b*, the third light source 33*c*, and the fourth light source 33*d*, so that the fourth light source 33*d* is configured to decrease the brightness to the first preset brightness br1 at a sixteenth time point t16, the third light source 33*c* is configured to decrease the brightness to the first preset brightness br1 at a seventeenth time point t17, the second light source 33*b* is configured to decrease the brightness to the first preset brightness br1 at an eighteenth time point t18, and the first light source 33*a* is configured to decrease the brightness to the first preset brightness br1 at a nineteenth time point t19.

In some-embodiments, the sixteenth time point t16 is earlier than the seventeenth time point t17, the seventeenth time point t17 is earlier than the eighteenth time point t18, and the eighteenth time point t18 is earlier than the nineteenth time point t19. In some embodiments, an interval between the sixteenth time point t16 and the seventeenth time point t17, an interval between the seventeenth time point t17 and the eighteenth time point t18, and an interval between the eighteenth time point t18 and the nineteenth time point t19 are tc. In some embodiments, the interval ta is the same as the interval tc. In some embodiments, the thirteenth rate v1*d* is less than the fourteenth rate v2*d*, the fourteenth rate v2*d* is less than the fifteenth rate v3*d*, and the fifteenth rate v3*d* is less than the sixteenth rate v4*d*.

FIG. 7A to FIG. 7E are respectively schematic diagrams showing brightness changes of a light emitting assembly 33 in a termination stage st3 according to an embodiment of this application.

Figures 7A, 7B, 7C, 7D, 7E:
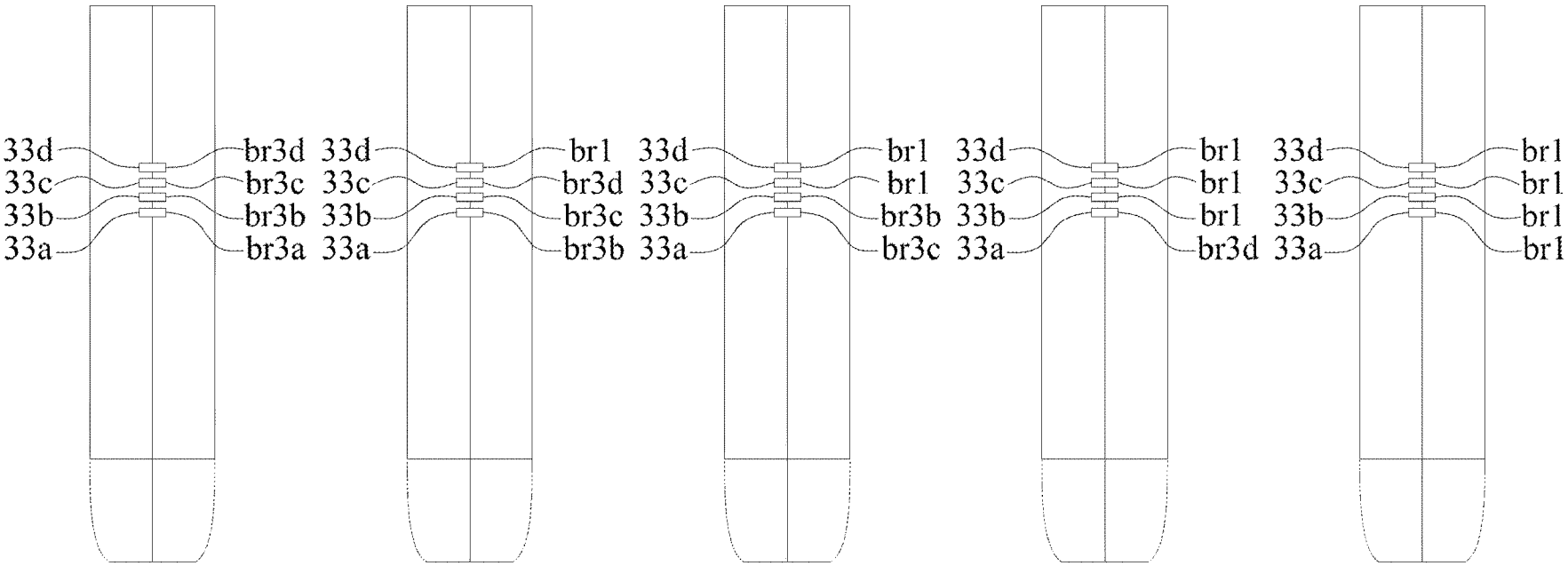
FIG. 7A to FIG. 7E are respectively schematic diagrams showing brightness changes of a light emitting assembly in a termination stage according to an embodiment of this application.

FIG. 7A shows the brightness of the light emitting assembly 33 after the fifteenth time point t15 and before the sixteenth time point t16. In response to the control signal CS, the processing circuit 32 controls the first light source 33*a*, the second light source 33*b*, the third light source 33*c*, and the fourth light source 33*d*, so that the first light source 33*a* is configured with brightness br3*a*, the second light source 33*b* is configured with brightness br3*b*, the third light source 33*c* is configured with brightness br3*c*, and the fourth light source 33*d* is configured with brightness br3*d*, wherein the brightness br3*a* is greater than the brightness br3*b*, the brightness br3*b* is greater than the brightness br3*c*, and the brightness br3*c* is greater than the brightness br3*d*.

FIG. 7B shows the brightness of the light emitting assembly 33 after the sixteenth time point t16 and before the seventeenth time point t17. In response to the control signal CS, the processing circuit 32 controls the first light source 33*a*, the second light source 33*b*, the third light source 33*c*, and the fourth light source 33*d*, so that the first light source 33*a* is configured with brightness br3*b*, the second light source 33*b* is configured with brightness br3*c*, the third light source 33*c* is configured with brightness br3*d*, and the fourth light source 33*d* is configured with the first preset brightness br1.

FIG. 7C shows the brightness of the light emitting assembly 33 after the seventeenth time point t17 and before the eighteenth time point t18. In response to the control signal CS, the processing circuit 32 controls the first light source 33*a*, the second light source 33*b*, the third light source 33*c*, and the fourth light source 33*d*, so that the first light source 33*a* is configured with brightness br3*c*, the second light source 33*b* is configured with brightness br3*d*, and the third light source 33*c* and the fourth light source 33*d* are configured with the first preset brightness br1.

FIG. 7D shows the brightness of the light emitting assembly 33 after the eighteenth time point t18 and before the nineteenth time point t19. In response to the control signal CS, the processing circuit 32 controls the first light source 33*a*, the second light source 33*b*, the third light source 33*c*, and the fourth light source 33*d*, so that the first light source 33*a* is configured with brightness br3*d*, and the second light source, the third light source 33*c*, and the fourth light source 33*d* are configured with the first preset brightness br1.

FIG. 7E shows the brightness of the light emitting assembly 33 at the nineteenth time point t19. In response to the control signal CS, the processing circuit 32 controls the first light source 33*a*, the second light source 33*b*, the third light source 33*c*, and the fourth light source 33*d*, so that the first light source 33*a*, the second light source, the third light source 33*c*, and the fourth light source 33*d* are configured with the first preset brightness br1.

According to the embodiments of FIG. 7A to FIG. 7E, in response to the control signal CS, the processing circuit 32 controls the light sources of the light emitting assembly 33 to be dimmed out and turned off in sequence from the fourth light source 33*d* at the topmost in the termination stage st3. In this way, the light emitting assembly 33 will present an effect similar to smoke flowing downwards when the user terminates using.

In some embodiments, the electronic vaporization device 100 is not limited to entering the termination stage st3 only after the cycle stage st2. In some embodiments, the user may stop using the electronic vaporization device 100 in the middle of the start stage st1, so that the electronic vaporization device 100 enters the termination stage st3 from the start stage st1.

Figure 8A:
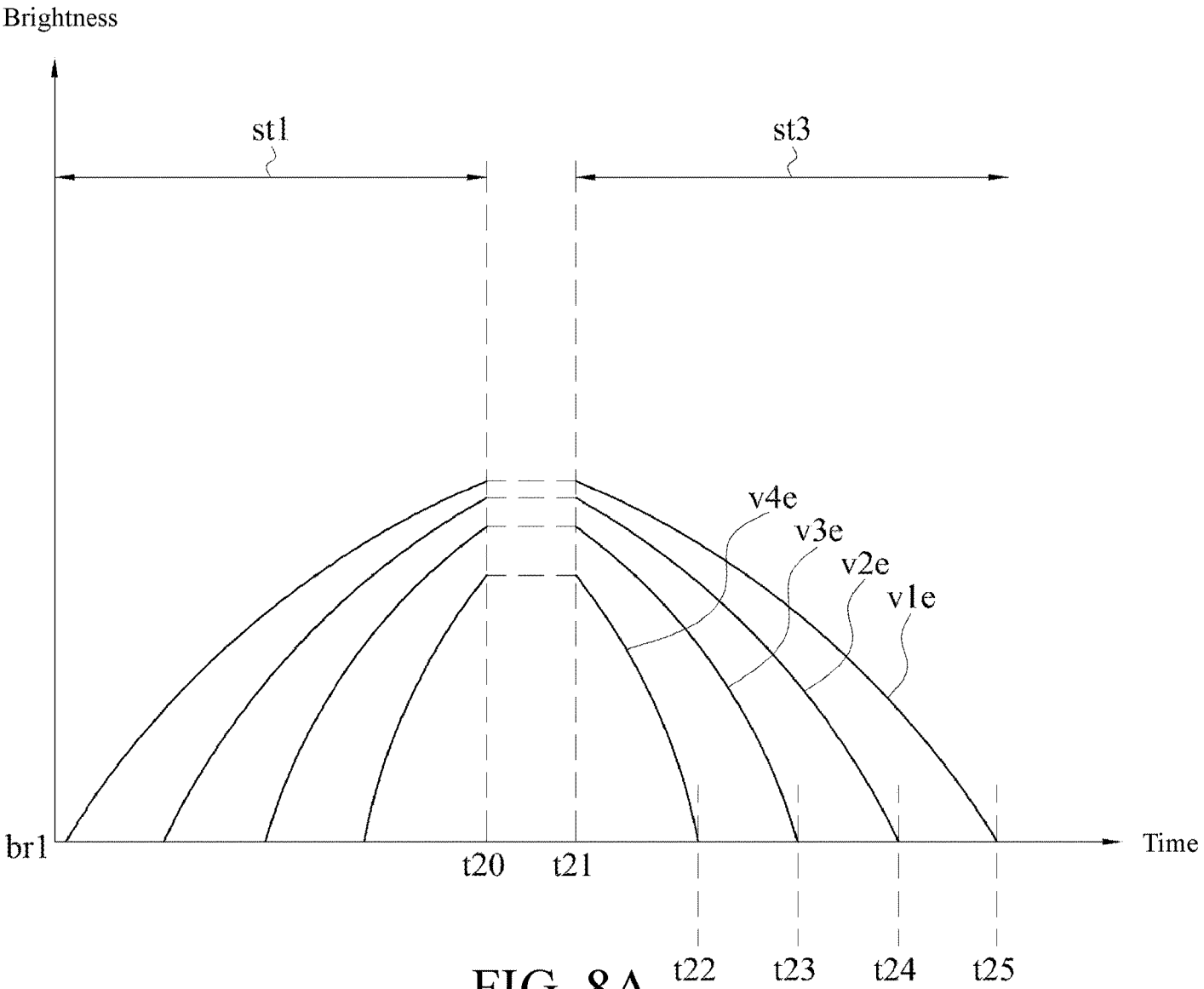
FIG. 8A and FIG. 8B are a schematic diagram showing brightness changes of a light emitting assembly when an electronic vaporization device according to another embodiment of this application is in different stages.

FIG. 8A is a schematic diagram showing brightness changes of a light emitting assembly 33 when an electronic vaporization device 100 according to another embodiment of this application is in different stages. In this embodiment of FIG. 8A, the user stops using at a twentieth time point t20 from the start stage st1. When the sensing device 31 senses that the user stops using after the twentieth time point t20, the control signal CS instructs the electronic vaporization device 100 to enter the termination stage st3. In response to the control signal CS, the processing circuit 32 controls the first light source 33*a*, the second light source 33*b*, the third light source 33*c*, and the fourth light source 33*d*, so that the first light source 33*a* is configured to decrease the brightness from current brightness at a seventeenth rate v1*e* at a twenty-first time point t21, the second light source 33*b* is configured to decrease the brightness from the current brightness at an eighteenth rate v2*e* at the twenty-first time point t21, the third light source 33*c* is configured to decrease the brightness from the current brightness at an nineteenth rate v3*e* at the twenty-first time point t21, and the fourth light source 33*d* is configured to decrease the brightness from the current brightness at a twentieth rate v4*e* at the twenty-first time point t21. In response to the control signal CS, the processing circuit 32 also controls the first light source 33*a*, the second light source 33*b*, the third light source 33*c*, and the fourth light source 33*d*, so that the fourth light source 33*d* is configured to decrease the brightness to the first preset brightness br1 at a twenty-second time point t22, the third light source 33*c* is configured to decrease the brightness to the first preset brightness br1 at a twenty-third time point t23, the second light source 33*b* is configured to decrease the brightness to the first preset brightness br1 at a twenty-fourth time point t24, and the first light source 33*a* is configured to decrease the brightness to the first preset brightness br1 at a twenty-fifth time point t25.

In some embodiments, the seventeenth rate vie is less than the eighteenth rate v2*e*, the eighteenth rate v2*e* is less than the nineteenth rate v3*e*, and the nineteenth rate v3*e* is less than the twentieth rate v4*e*. In some embodiments, the seventeenth rate vie, the eighteenth rate v2*e*, the nineteenth rate v3*e*, and the twentieth rate v4*e* are the same. Due to different initial brightness of the first light source 33*a*, the second light source 33*b*, the third light source 33*c*, and the fourth light source 33*d* at the twenty-first time point t21, in both cases, the first light source 33*a*, the second light source 33*b*, the third light source 33*c*, and the fourth light source 33*d* may decrease the brightness to the first preset brightness br1 at different time points.

In some embodiments, the seventeenth rate v1*e* is greater than the eighteenth rate v2*e*, the eighteenth rate v2*e* is greater than the nineteenth rate v3*e*, and the nineteenth rate v3*e* is greater than the twentieth rate v4*e*. Due to different initial brightness of the first light source 33*a*, the second light source 33*b*, the third light source 33*c*, and the fourth light source 33*d* at the twenty-first time point t21, the first light source 33*a*, the second light source 33*b*, the third light source 33*c*, and the fourth light source 33*d* may decrease the brightness to the first preset brightness br1 at the same time point by adjusting the seventeenth rate v1*e*, the eighteenth rate v2*e*, the nineteenth rate v3*e*, and the twentieth rate v4*e*.

Figure 8B:
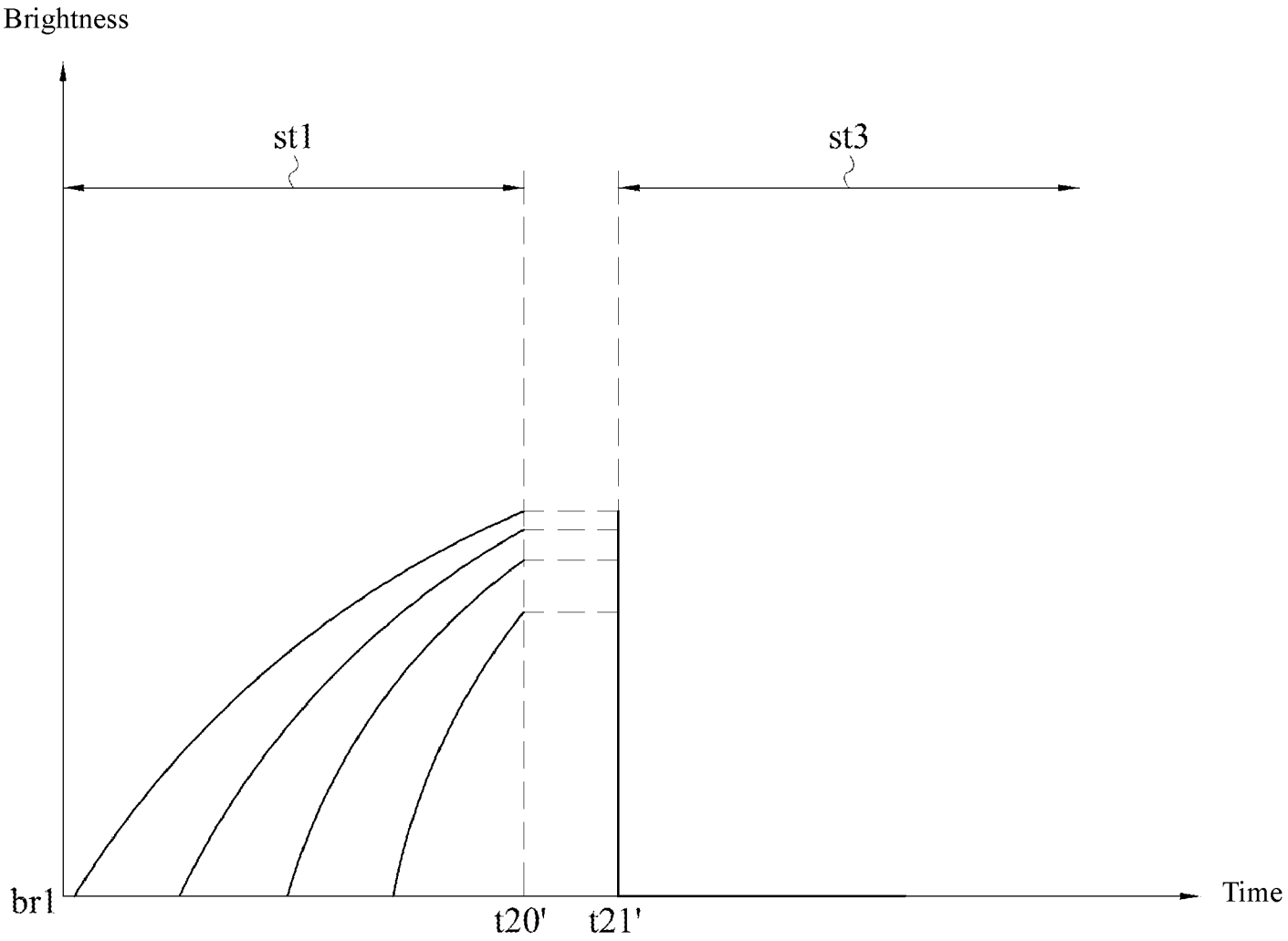

FIG. 8B is a schematic diagram showing brightness changes of a light emitting assembly 33 when an electronic vaporization device 100 according to another embodiment of this application is in different stages. Unlike the embodiment of FIG. 8A, in this embodiment of FIG. 8B, if the user stops using at a time point t20' from the start stage st1, the control signal CS instructs the electronic vaporization device 100 to enter the termination stage st3. In response to the control signal CS, the processing circuit 32 controls the first light source 33*a*, the second light source 33*b*, the third light source 33*c*, and the fourth light source 33*d*, so that the first light source 33*a*, the second light source 33*b*, the third light source 33*c*, and the fourth light source 33*d* are configured to directly decrease the brightness from the current brightness to the first preset brightness br1 at a time point t21'.

After reading the above embodiments, those skilled in the art should understand that if the user stops using in the middle of the cycle stage st2, the control signal CS instructs the electronic vaporization device 100 to enter the termination stage st3. In response to the control signal CS, the processing circuit 32 can also control the light emitting assembly 33 according to the embodiment of FIG. 8A or FIG. 8B. The detailed explanation is omitted here to save space.

It should be noted that in addition to the components described in FIG. 3, the electronic vaporization device body 100B may also include other necessary components to achieve the functions of the electronic vaporization device 100. For example, the electronic vaporization device body 100B may also include a power supply 34 configured to store electrical energy. In some embodiments, the power supply 34 is electrically connected to the processing circuit 32.

In some embodiments, the power supply 34 may be a battery. In some embodiments, the power supply 34 may be a rechargeable battery. In some embodiments, the power supply 34 may be a disposable battery.

In some embodiments, the processing circuit 32 may also control the light sources of the light emitting assembly 33 according to the amount of electrical energy (namely, residual power) in the power supply 34. In this way, the residual power of the electronic vaporization device 100 can be displayed through a light effect to remind the user.

FIG. 9A to FIG. 9D are respectively schematic diagrams showing brightness changes of the light emitting assembly 33 of an electronic vaporization device according to an embodiment of this application at different residual powers of the power supply 34.

In this embodiment of FIG. 9A, when the residual power of the power supply 34 is 75% to 100%, the processing circuit 32 controls the first light source 33*a*, the second light source 33*b*, the third light source 33*c*, and the fourth light source 33*d*, so that the first light source 33*a*, the second light source 33*b*, the third light source 33*c*, and the fourth light source 33*d* are configured with the target brightness br1.

In this embodiment of FIG. 9B, when the residual power of the power supply 34 is 50% to 75%, the processing circuit 32 controls the first light source 33*a*, the second light source 33*b*, the third light source 33*c*, and the fourth light source 33*d*, so that the first light source 33*a*, the second light source 33*b*, and the third light source 33*c* are configured with the target brightness brt, and the fourth light source 33*d* is configured with the first preset brightness br1.

In this embodiment of FIG. 9C, when the residual power of the power supply 34 is 25% to 50%, the processing circuit 32 controls the first light source 33*a*, the second light source 33*b*, the third light source 33*c*, and the fourth light source 33*d*, so that the first light source 33*a* and the second light source 33*b* are configured with the target brightness, and the third light source 33*c* and the fourth light source 33*d* are configured with the first preset brightness br1.

In this embodiment of FIG. 9D, when the residual power of the power supply 34 is 0% to 25%, the processing circuit 32 controls the first light source 33*a*, the second light source 33*b*, the third light source 33*c*, and the fourth light source 33*d*, so that the first light source 33*a* is configured with the target brightness brt, and the second light source 33*b*, the third light source 33*c*, and the fourth light source 33*d* are configured with the first preset brightness br1.

In other embodiments, the residual power of the power supply 34 can be presented without limiting it to only the first preset brightness br1 and the target brightness brt. The residual power of power supply 34 can be presented more accurately by using more brightness as units between the first preset brightness br1 and the target brightness brt. Those skilled in the art should easily understand an implementation method after reading the above embodiments, and the detailed explanation is omitted here to save space.

As used herein, the terms "approximately", "basically", "basic", and "about" are used to describe and consider small changes. When used in conjunction with an event or situation, the term can refer to examples of events or situations occurring precisely and examples of events or situations occurring very approximately. As used herein relative to a given value or range, the term "about" generally means within ±10%, ±5%, ±1%, or ±0.5% of the given value or range. The range can be represented herein as from one end point to another end point or between two end points. Unless otherwise specified, all scopes disclosed herein include end points. The term "basically coplanar" can refer to two surfaces located along the same plane within a few micrometers (m), for example, located along the same plane within 10 μm, 5 μm, 1 μm, or 0.5 μm. When values or characteristics are "basically" the same, the term can refer to values within ±10%, ±5%, ±1%, or ±0.5% of an average value of the values mentioned.

As used herein, the terms "approximately", "basically", "basic", and "about" are used to describe and explain small changes. When used in conjunction with an event or situation, the term can refer to examples of events or situations occurring precisely and examples of events or situations occurring very approximately. For example, when used in conjunction with a value, the term can refer to a change range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the values (for example, less than or equal to f 5%, less than or equal to ±4%, less than or equal to ±3%, less than or equal to ±2%, less than or equal to ±1%, less than or equal to ±0.5%, less than or equal to ±0.1%, or less than or equal to ±0.05%), the two values can be considered as being "basically" or "approximately" the same. For example, being "basically" parallel can refer to an angle change range less than or equal to 10° relative to 0°, for example, less than or equal to ±5°, less than or equal to 4°, less than or equal to 30, less than or equal to ±2°, less than or equal to ±1°, less than or equal to ±0.5°, less than or equal to ±0.1°, or less than or equal to +0.05°. For example, being "basically" perpendicular can refer to an angle change range less than or equal to ±100 relative to 90°, for example, less than or equal to 5°, less than or equal to ±4°, less than or equal to ±3, less than or equal to ±2°, less than or equal to 1°, less than or equal to ±0.5°, less than or equal to ±0.1°, or less than or equal to ±0.05°.

For example, if a displacement between two surfaces is equal to or less than 5 μm, equal to or less than 2 μm, equal to or less than 1 μm, or equal to or less than 0.5 μm, the two surfaces can be considered as being coplanar or basically coplanar. If a displacement between any two points on a surface relative to a plane is equal to or less than 5 μm, equal to or less than 2 μm, equal to or less than 1 μm, or equal to or less than 0.5 μm, the surface can be considered as being a plane or basically a plane.

As used herein, the terms "conductive", "electrically conductive", and "conductivity" refer to a capability of transferring current. Conductive materials typically indicate those materials that exhibit minimal or zero resistance to current flowing. One measure of the conductivity is Siemens per meter (S/m). Usually, a conductive material is a material with a conductivity greater than approximately 104 S/m (for example, at least 105 S/m or at least 106 S/m). The conductivity of the material can sometimes vary with temperature. Unless otherwise specified, the conductivity of the material is measured at a room temperature.

As used herein, the singular terms "a/an" and "the" may include plural indicators unless the context otherwise specifies. In some embodiments, an assembly being "on" or "above" another assembly may cover a situation where the previous assembly is directly on the latter assembly (for example, in physical contact with the latter assembly), and a situation where one or more intermediate assemblies are located between the previous assembly and the latter assembly.

As used herein, for ease of description, spatial relative terms such as "under", "below", "lower", "above", "upper", "left side", "right side", and the like can be used herein to describe a relationship between one assembly or feature and another assembly or feature as illustrated in the figure. In addition to the orientations depicted in the figures, the spatial relative terms are intended to encompass different orientations of devices in use or operation. The device can be oriented in other ways (rotated 90 degrees or in other orientations), and the spatial relative descriptors used herein can also be explained correspondingly. It should be understood that when an assembly is referred to as "connected to" or "coupled to" another assembly, it can be directly connected or coupled to another assembly, or there can be an intermediate assembly.

The previous text provides an overview of several embodiments and detailed features of the present disclosure. The embodiments described in the present disclosure can be easily used as a basis for designing or modifying other processes, as well as structures for performing the same or similar purposes and/or obtaining the same or similar advantages of the embodiments introduced herein. These equivalent constructions do not depart from the spirit and scope of the present disclosure, and different changes, substitutions, and changes can be made without departing from the spirit and scope of the present disclosure.

We claim:

1. An electronic vaporization device, comprising:

an vaporizable material storage device, configured to store an vaporizable material; and an electronic vaporization device body, detachably connected to the vaporizable material storage device, and comprising:

a processing circuit;

a sensing device, connected to the processing circuit, the sensing device being configured to sense changes in air flow and transmit a control signal to the processing circuit; and a first light source and a second light source, separately electrically connected to the processing circuit, wherein the processing circuit presets a first control time point and a second control time point; the first control time point corresponds to a time point when a user starts to use the electronic vaporization device and is earlier than the second control time point; the first light source is configured to increase the brightness from first preset brightness at a first rate at illumination time, and the second light source is configured to increase the brightness from the first preset brightness at a second rate at illumination time; the illumination time of the first light source corresponds to the first control time point; the illumination time of the second light source corresponds to the second control time point; and the first rate is less than the second rate.

2. The electronic vaporization device according to claim 1, wherein the first light source and the second light source are configured to increase the brightness to target brightness at a third control time point; and wherein the second control time point is earlier than the third control time point.

3. The electronic vaporization device according to claim 2, wherein when the user continuously smokes the electronic vaporization device, and the first light source and the second light source reach the target brightness, the electronic vaporization device enters a cycle stage;

the first light source is configured to decrease the brightness from the target brightness at a third rate at a fourth control time point;

the second light source is configured to decrease the brightness from the target brightness at a fourth rate at a fifth control time point;

wherein the fourth control time point is earlier than the fifth control time point, and the third rate is less than the fourth rate.

4. The electronic vaporization device according to claim 3, wherein the first light source and the second light source are configured to decrease the brightness to second preset brightness at a sixth control time point;

wherein the fifth control time point is earlier than the sixth control time point, and the second preset brightness is greater than the first preset brightness.

5. The electronic vaporization device according to claim 4, wherein the first light source is configured to increase the brightness from the second preset brightness at a fifth rate at a seventh control time point;

the second light source is configured to increase the brightness from the second preset brightness at a sixth rate at an eighth control time point;

wherein the seventh control time point is earlier than the eighth control time point, and the fifth rate is less than the sixth rate.

6. The electronic vaporization device according to claim 5, wherein the first light source and the second light source are configured to increase the brightness from the second preset brightness to the target brightness at a ninth control time point;

wherein the eighth control time point is earlier than the ninth control time point.

7. The electronic vaporization device according to claim 5, wherein an interval between the fourth control time point and the fifth control time point is the same as an interval between the seventh control time point and the eighth control time point.

8. The electronic vaporization device according to claim 2, wherein when the user stops using the electronic vaporization device, the electronic vaporization device enters a termination stage;

the first light source and the second light source are configured to decrease the brightness separately at a third rate and a fourth rate at the third control time point, and decrease the brightness to the first preset brightness separately at a fourth control time point and a fifth control time point;

wherein the third rate is less than the fourth rate.

9. The electronic vaporization device according to claim 8, wherein an interval between the first control time point and the second control time point is the same as an interval between the fourth control time point and the fifth control time point.

10. The electronic vaporization device according to claim 1, further comprising:

a power supply, configured to store and supply electric energy, wherein the processing circuit is further configured to control the brightness of the first light source and the brightness of the second light source according to the electric energy stored in the power supply.

* * * * *